United States Patent [19]

McDermott

[11] Patent Number: 4,669,990

[45] Date of Patent: Jun. 2, 1987

[54] SIGNAL DEVICE

[76] Inventor: Kevin McDermott, 196 Phillips Dr., Hampsted, Md. 21074

[21] Appl. No.: 635,825

[22] Filed: Jul. 30, 1984

[51] Int. Cl.[4] ..... B63B 21/52

[52] U.S. Cl. ..... 441/16; 200/61.52

[58] Field of Search ..... 441/6-18; 200/85 R, 81.6, 61.52 , DIG. 49; 116/202, 215; 340/521, 689

[56] References Cited

U.S. PATENT DOCUMENTS

| | | | |
|---|---|---|---|
| 957,222 | 5/1910 | Quee | 441/17 |
| 1,761,681 | 6/1930 | Reis, Jr. et al. | 200/61.52 |
| 1,855,581 | 4/1932 | Meade | 200/61.52 |
| 2,355,013 | 8/1944 | Rochestie | 441/17 |
| 2,766,346 | 10/1956 | Valdes | 200/61.52 |
| 3,564,171 | 2/1971 | Hammond | 200/61.52 |
| 3,889,774 | 6/1975 | Schwenk | 200/61.52 |

FOREIGN PATENT DOCUMENTS

| | | | |
|---|---|---|---|
| 2248974 | 5/1975 | France | 441/17 |

*Primary Examiner*—Galen Barefoot
*Assistant Examiner*—Jesûs D. Sotelo
*Attorney, Agent, or Firm*—Kenyon & Kenyon

[57] ABSTRACT

The battery operated signal device employs a gravity operated switching system with a time delay. The time delay is effected in one embodiment by having a weighted element move through a tortuous path when the signal device is thrown into the water before activating the contacts of a switch to energize a circuit. In other embodiments, the time delay is effected by pendular members which pivot when the signal device is inverted to either actuate a switch or to permit passage of a ball to actuate the switch. The time delay extends the time required to turn on the light so that forces developed on the light by the pitching, plunging and rolling action of a vessel do not result in intermittent unwanted operation.

16 Claims, 11 Drawing Figures

SIGNAL DEVICE

This invention relates to a signal device and a gravity actuated switching system. More particularly, this invention relates to a floating signal device. Still more particularly, this invention relates to a floating water light for marine use.

As is known, various types of devices have been used for signalling purposes. In particular, for marine use, various types of life saving devices have been known for emitting a distress signal such as a light beam or other signal. One known type of device includes a buoyant tube which contains a battery surmounted by a light. Normally, such a device is stored in an inverted position on a vessel and is so weighted that, when thrown into the water, the device rights itself. The device also has a gravity switch which is able to act in the righted position to close a circuit causing energization of the light. Generally, the switch contains a weight which, when the device is inverted, travels on a route formed by a tube to a position causing the closing of an electrical circuit.

However, it has been found that the use of such gravity-activated devices on shipboard pose problems. For example, a gravity switch can be activated by the plunging, pitching and rolling of a vessel in rough seas while the device is stored and in the inverted position. That is, during plunging of a vessel in rough seas, the actuating weight in a stored device might well rise within the tube, particularly where the descending motion of the mounted device exceeds the gravitation acceleration rate of 32.2 feet per second per second.

The signal device is normally stored on deck above the center of gravity of the ship. Rolling would be around the center of gravity and the centrifugal force on rolling would be away from the center or, in this case, upward. Thus, the force would tend to raise a stored actuating weight. The condition is further aggravated by the fact that the tilt of the ship may be such that the restraining force of gravity may not be fully effective at a particular time.

Likewise, a moving vessel is subject to winds so that the impact of waves and rolling possibly synchronized with wave motion all contribute individually or collectively to the motion of the vessel. Thus, forces can act on a gravity-activated signal device when in an inverted stored position which cause the weight to move into a position to close the electrical circuit. As a result, battery energy can be ineffectively consumed when the device is in the inverted stored position so that when the device is needed for use, there may be insufficient battery energy remaining to activate the signal device.

Accordingly, it is an object of the invention to provide a gravity activated signal device which is not adversely effected by the plunging, pitching and rolling motions of a vessel.

It is another object of the invention to provide a buoyant battery operated signal device which has a time-delay characteristic.

It is another object of the invention to provide a battery operated signal device which can be stored in an inverted position with minimal risk of the battery becoming deenergized due to the pitching and rolling motions of a vessel.

It is a further object of this invention to provide a gravity operated signal device which avoids the issuance of false signals.

Briefly, the invention provides a signal device for use with a vessel which is comprised of a buoyant housing which can be mounted on the vessel, means mounted at a lower end of the housing for emitting a signal and a gravity-operated switching system disposed in the housing for actuating the signal means in response to inversion of the housing with the actuating being substantially immune to the rolling and pitching of the vessel.

Realizing the characteristics of wave and sea motion, extreme conditions may be so rare that practical limits can be set where the chance of false flashing is remote. By controlling the design features, a mechanical path or electrical circuit can be constructed with a time delay such that there would not be a false flash.

In these cases, a switch could only be considered a time delay type if the delay imposed is such as to cause a delay in operation of the signal of at least 0.075 second.

Of note, the use of a passegeway of specific construction and dimensions allows the manufacture of a gravity operated switch with a predictable minimal time delay function.

A wide variety of devices can be constructed to achieve the desired effect of reducing the probability of false signals. These include extending the path of travel of the actuating element, providing means within the passageway to retard the movement of the activating element through the passageway, by requiring the weight to change direction, by requiring the weight to move in a direction oblique to the gravitational force thus reducing its effect or by the use of a pivoted blocking member.

One form of the switching system includes a switch having contact means disposed in a normally open position, a tortuous passageway extending from the contact means and an element which is movably disposed in the passageway and sized to move through the passageway under gravity in order to close the contact means when the housing is inverted.

The passageway may be of various configurations such as zigzag, spiral and helical. In this regard, the use of a sloping passageway also has a positive effect in that the gravitational force is not fully effective on the moving element but becomes a function of the slope angle of the passageway. This further retards the progress of the descending weight. Further, the passageway may be made up of a series of tubular sections which are arranged to successively change the direction of motion of the element during movement toward the contact. Thus the passageway can be so shaped that acceleration of the weight is not continuous but is broken into steps by changing the direction of motion.

The element used to activate the contact means of the switch may be spherical or other suitable shape. For example, the element may be of disc shape for example with flat or rounded sides. In this case, the passageway would be of rectangular cross section so that the disc may move through the passageway.

The use of a route with a rectangular cross-section which would provide a pathway for a disc shaped element would be of particular value if the switches are used in pairs with the contacts connected in series. Switches would be placed in vertical planes displaced by 90 degrees. Tipping a unit on one side would mean that only one element would roll the other would move only sluggishly due to frictional limitations. The electrical circuit would be complete only when both switches close.

The operating element may be magnetic with use of this characteristic to operate a switch exterior to the passageway.

In addition to methods to just time delay the switching action, an equivalent effect can be obtained by impeding the complete movement of the element except on almost complete turn over. By the use of blocking elements that would clear the path only on turn over, a major part of the danger of inadvertent operation can be avoided.

These and other objects and advantages of the invention will become more apparent from the following detailed description taken in conjunction with the accompanying drawings wherein.

Figure 4A:
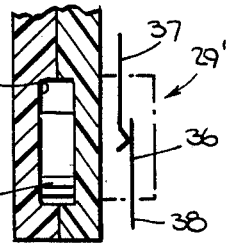
FIG. 4 illustrates a view taken on line 4—4 of FIG. 3.
Figure 5:
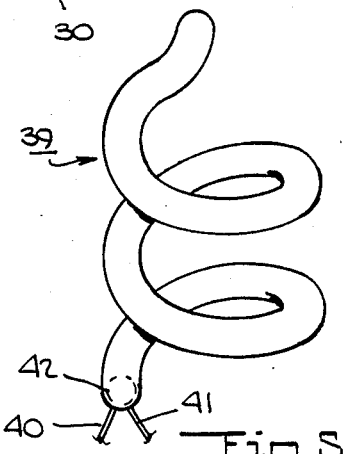
Figure 6:
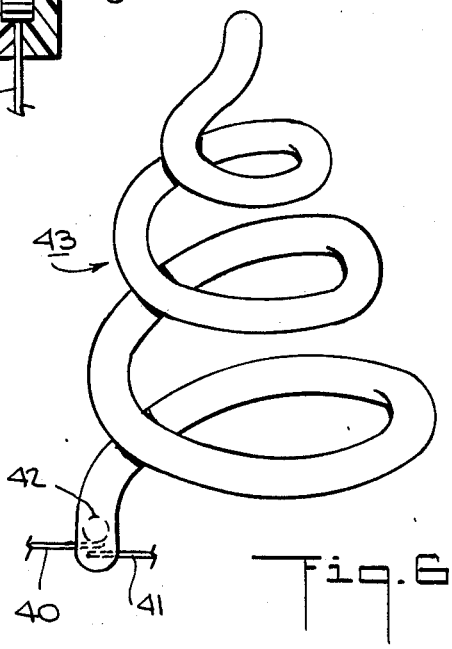
Figure 7:
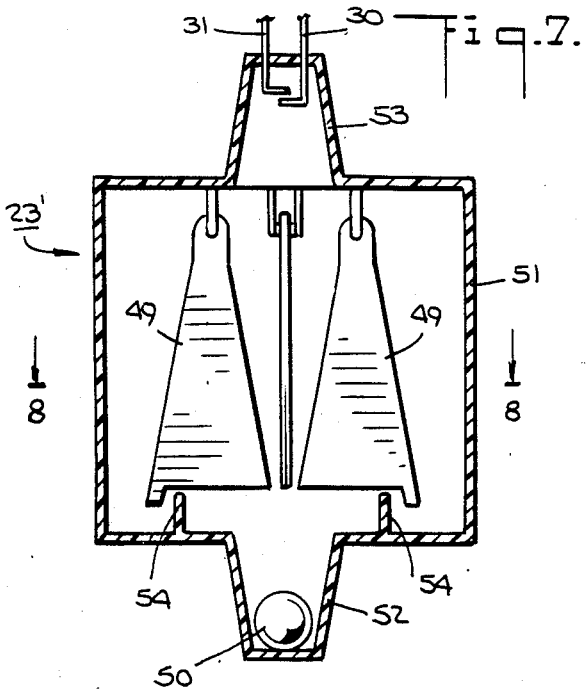
Figure 8:
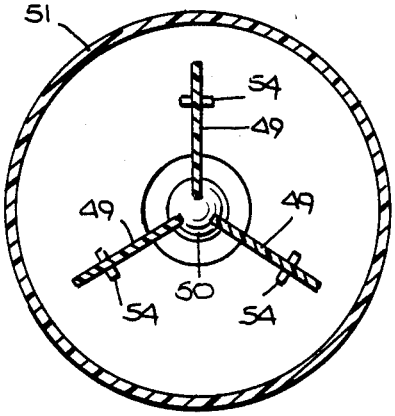
Figure 9:
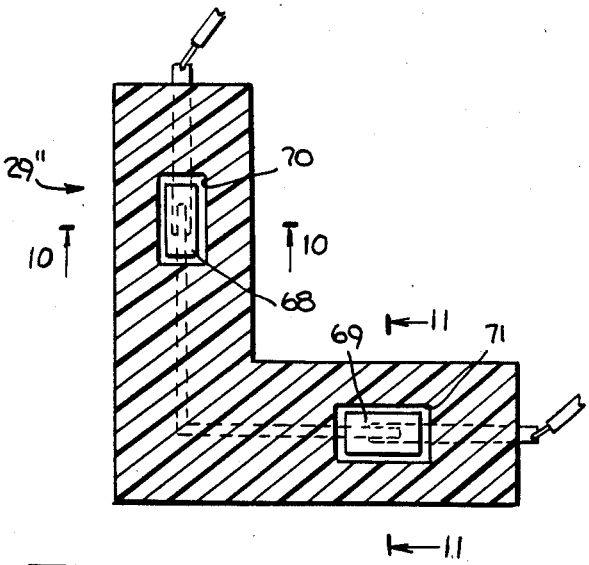
Figure 10:
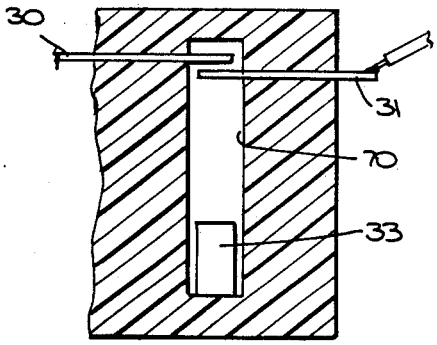

FIG. 4*a* illustrates a partial view of a modified signal device employing a magnetic switch in accordance with the invention;

FIG. 5 illustrates a view of a helical passageway in accordance with the invention;

FIG. 6 illustrates a view of a spiral passageway in accordance with the invention;

FIG. 7 illustrates a cross-sectional view of a modified time delay switch which includes hinged vanes to impede movement of an actuating element in accordance with the invention;

FIG. 8 illustrates a view taken on line 7—7 of FIG. 9;

FIG. 9 illustrates a plan view of a modified signal device having two switches arranged in perpendicular relation in accordance with the invention;

FIG. 10 illustrates a view taken in 10—10 of FIG. 9, and

Figure 11:
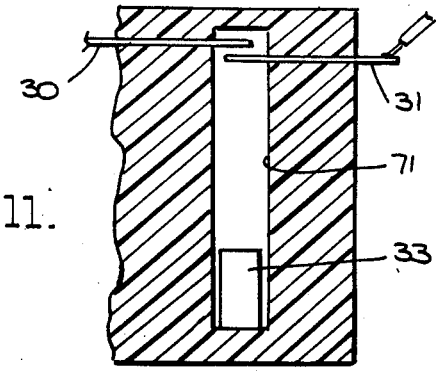

FIG. 11 illustrates a view taken on line 11—11 of FIG. 9.

Figure 2:
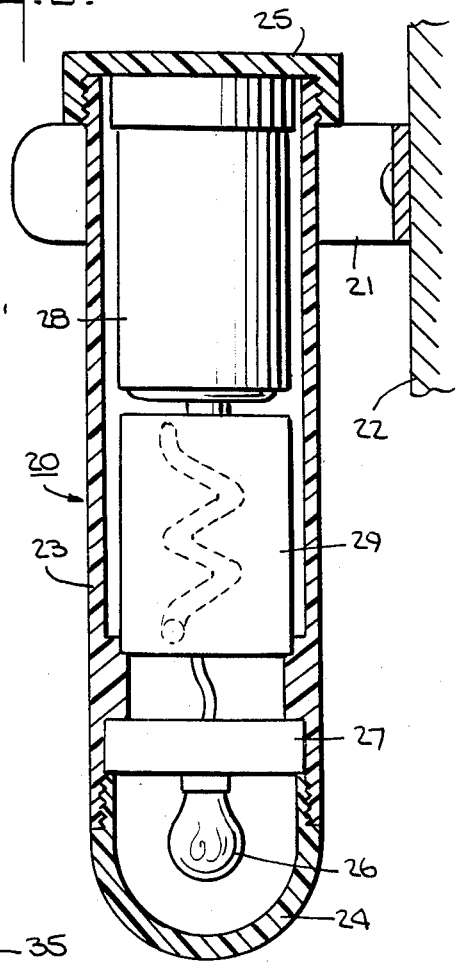
FIG. 2 illustrates a cross-sectional view of the signal device of FIG. 1 in an inverted stored position on a vessel.

Referring to FIG. 2, the signal device 20 is shown mounted in an inverted stored position on a bracket 21 secured on the wall 22 of a vessel (not otherwise shown). The signal device 20 has a buoyant housing 23, for example of cylindrical tube-like shape. The housing 23 has a lens 24 secured, as by threading, at the lower end, as viewed, as well as a closure cap 25 at the upper end which is also secured by threading. As indicated, the cap 25 is of larger diameter than the housing 23 so as to form an abutment against the mounting 22.

The signal device 20 also includes a signal means 26 mounted at the lower end of the housing 23 for emitting a signal. For example, the signal means 26 may be in the form of a light bulb or lamp for emitting light through the lens 24. In addition, the signal means includes a flashing device 27 for pulsing the light bulb 26. In addition, a battery 28 is mounted within the housing 20 for energizing the signal means 26.

Figure 1:
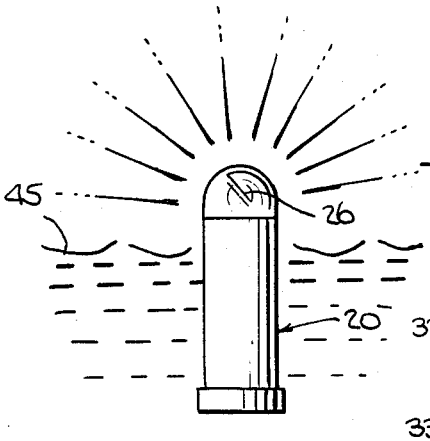
FIG. 1 illustrates a view of a floating signal device constructed in accordance with the invention.

Further, a time-delayed gravity-operated switching system 29 is mounted in the housing 23 between the battery 28 and the signal means 26 for actuating the signal means 26 in response to inversion of the housing 23 as indicated in FIG. 1.

Figure 3:
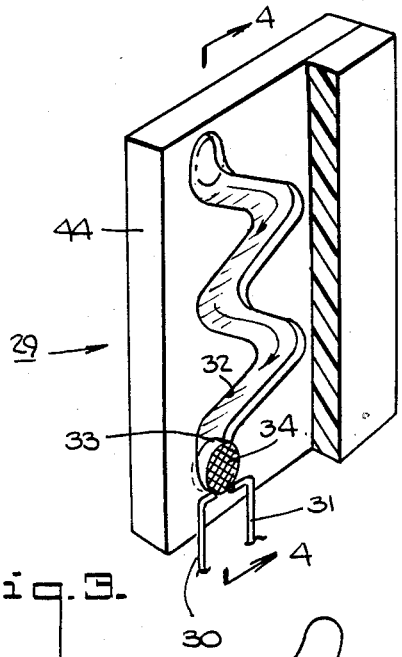
FIG. 3 illustrates a cut away view of a switching system constructed in accordance with the invention.

Referring to FIG. 3, the switching system 29 includes a switch having contact means in the form of a pair of spaced apart contacts 30, 31 for generating a circuit, a tortuous passageway 32 i.e. one with repeated twists, bends or turns, which extends from the contacts 30, 31 and a weighted element or body 33 which is disposed in the passageway 32. One of these contacts can be eliminated if the element is conductive and the wall conductive and made part of the circuit. When the signal device 20 is in the inverted stored position as shown in FIG. 2, the element 33 is disposed towards the lower end of the housing 23, as viewed, while the contacts 30, 31 are located towards the upper end, as viewed.

Figure 4:
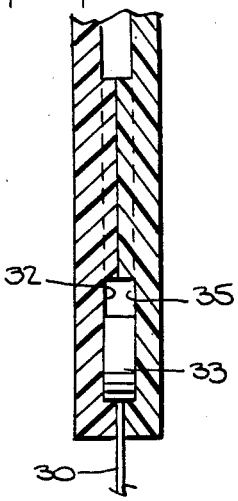

The tortuous path 32 of the switching system 29 is formed of a series of tubular sections arranged in a zig-zag manner to successively change the direction of motion of the element 33 during movement through the passageway 32. In addition, as indicated in FIG. 4, the passageway 32 is of rectangular cross section while the element 33 is in the form of a disc. Alternatively, the passageway 32 may have any other suitable non-round cross-section.

When the signal device 20 is disposed in a righted position as shown in FIG. 1, the weighted element 33 moves from the stored position of the passageway 32 to the now-righted lower end of the passageway 32 as viewed in FIG. 3. During this time, the element 33 traverses through the sections of the passageway 32 over a time period of at least 0.075 second. On arrival of the contacts 30, 31, the element 33 bridges the contacts 30, 31 so as to complete an electrical circuit from the battery 28 to the flashing device 27 so as to cause the light 26 to be activated.

Of note, the weighted element 33 is sized so as to move through the passageway 32 under gravity. Further, the flat side surface 34 of the element 33 and the opposed wall 35 of the passageway 32 are roughened or serrated so as to impede the sliding of the disc 33 along the passageway 32 when tipped sideways. In this way, the disc 33 would not roll up the passageway 32 but would tend to slide up the wall 35 against frictional resistance.

Referring to FIG. 4*a* wherein like reference characters indicate like parts as above, the switching system 29' may use a magnetic switch 36 with magnetic contacts 37, 38 which are responsive to a magnetic weighted element 33.

Referring to FIG. 5, the tortuous passageway 39 may be in the form of a helix. In this case, the passageway 39 may be formed of glass or other insulating material while the contacts 40, 41 are located at the larger end of the helix. In addition, the weighted element may be in the form of a metal ball 42 which is capable of completing the circuit between the contacts 40, 41. Alternatively, the moving element may be in the form of a globule of mercury. Of note, the helical passageway 39 is shown in the circuit closing position, i.e. the righted position. If inverted and stored, the activating element 42 would be located at the upper end, as viewed.

Referring to FIG. 6, wherein like reference characters indicate like part as above, the tortuous passageway may be in the form of a spiral 43. In addition, the contacts 40, 41 may be disposed in a normally open overlapping manner so that when the element 42 arrives, one contact 40 is moved into a closed position on the other contact 41.

Referring to FIGS. 3 and 4, the passageway 32 may be disposed within a molded plastic body 44 or be formed as part of the body which is sized to fit within the housing 23 (see FIG. 2). As indicated, the body 44 may be of rectangular cross section so as to fit diametrically across the housing 23. Alternatively, the body 44 can be omitted as indicated in FIGS. 5 and 6 wherein the path construction itself defines the passageway for the weighted element 42.

Alternatively, the passageway for the weighted element may be formed by a path (not shown) which is provided with pins to divert the element from side to side as the element moves as in a pinball machine. Further, the tortuous passageway 32 and the curvilinear passageways 39, 43 described above may also be provided with a restrction (not shown) for braking the movement of the weighted element 33, 42. Such a restriction would further retard the movement of the element and thus increase the time delay for actuation of the signal means 26.

In use, the signal device 20 can be simply lifted from the bracket 21 and tossed into the water 45 as indicated in FIG. 1. With the housing 23 being buoyant and the components 26–29 being properly arranged, the device 20 moves into a righted position, as viewed. At this time, the signal means 26 is located at the upper end. After a time delay, caused by the tortuous movement of the weighted element 33 through the passageway 32 (see FIG. 3) the contacts 30, 31 are closed and the light bulb 26 begins to flash.

It has been anticipated that the switching system may use a means in the passageway 32, 39, 43 to retard movement of the element 33, 42 such as a fluid damping medium, e.g. a liquid or a gas. Further, if the liquid is insulating the element can be magnetic to operate an exterior switch as at 29' in FIG. 4*a*.

Referring to FIGS. 7 and 8, wherein like characters indicate like parts as above, the switching system 29' may employ a means in the form of a plurality of pendular members 49 to retard movement of an actuating element in the form of a ball 50. For example, three similar pendular members set at 120 degrees apart, are disposed to move between a rest position as shown and a position permitting the actuating element 50 to pass.

As shown in FIG. 8, the switching system 23' has a housing 51 of circular shape with the pendular members 49 arranged radially to close off a vertical path of the ball 50. Further, as shown in FIG. 7, the ball 50 is contained within a conically shaped recess 52 in the housing 51 while a similar recess 53 is disposed at an upper end, as viewed, to contain the switch contacts 30, 31. Restraining projections 54 are also formed or provided on the floor of the housing 51 to define the rest positions of the pendular members 49.

Should the housing 51 be inverted, one or more of the members 49 will tip to the outside thus opening a path for the ball 50 to move past the members 49 into the recess 53 so as to close the contacts 30, 31.

Referring to FIGS. 9 to 11, the switching system 29'' may include a pair of switches 68, 69 which are connected in series to the signal means (not shown) as well as a pair of passageways 70, 71 which are disposed in vertical planes placed angularly, e.g. at 90 degrees to each other to be nonparallel. Each switch contains a disc element 33 and has contacts 30, 31 arranged at the end of a rectangular passageway 70, 71. In operation, both switches 68, 69 would have to close to actuate the signal device. If only one switch were used instead of two, that switch would be placed in a position with the flat sides of the element 33 parallel to the vessel axis if the ship was most vulnerable to side rolling.

The invention thus provides a signal device which can be stored for relatively long periods of time on a vessel with minimal risk of becoming deactivated due to battery exhaustion.

The invention also provides a gravity actuated switching system which can be employed not only for floating signal devices but also for other electrical circuits which are responsive to erratic motion.

Further, the invention provides a signal device which is not readily activated by disruptive forces caused by the pitching and rolling action of a vessel in rough waters or other erratic motions. Still further, the invention provides a signal device of compact construction which can be operated on a time delayed basis.

What is claimed is:

1. A signal device comprising a buoyant housing;

signal means mounted at a lower end of said housing for emitting a signal;

a switch in said housing for actuating said signal means;

a tortuous passageway in said housing extending from said switch towards said lower end of said housing, said passageway having a series of at least three sections arranged in zig-zag manner; and an element disposed within said passageway for actuating said switch, said element being movably disposed in said passageway near said lower end of said housing for movement through said passageway under gravity towards an upper end of said housing in response to inversion of said housing.

2. A signal device as set forth in claim 1 wherein said signal means is a light.

3. A signal device as set forth in claim 1 which further comprises at least one restriction in said passageway for braking the movement of said element towards said switch.

4. A signal device as set forth in claim 1 wherein said element is a disc and said passageway has a rectangular cross-section.

5. A signal device as set forth in claim 1 wherein said signal means includes a light at said lower end; a battery selectively connected to said light, said switch being interposed between said battery and said light and having a time delay characteristic.

6. A signal device as set forth in claim 1 wherein said switch and said element are magnetically co-responsive

7. A signal device comprising a buoyant housing;

signal means mounted at a lower end of said housing for emitting a signal; and a time-delayed gravity-operated switching system disposed in said housing for actuating said signal means in response to inversion of said housing with a time delay of at least 0.075 seconds, said switching system comprising a pair of switches connected in series; a pair of passageways located in vertical planes set angularly to each other in non-parallel relation, each passageway extending to a respective switch; and a pair of elements, each element being movably mounted in a respective passageway to move through said respective passageway under gravity to actuate a respective switch.

8. A gravity actuated switching system comprising contacting means for energizing a circuit;

a vertically disposed tortuous passageway having said contact means at an upper end and repeated turns extending from said contact means, said passageway having a series of at least three sections arranged in a zig-zag manner; and a weighted body disposed in said passageway in spaced relation to said contact means, said body being sized to move downwardly through said passageway under gravity upon inversion of said passageway to close said contact means in response to said contact means being then disposed at a lower end of said passageway.

9. A gravity actuated switching system as set forth in claim 8 wherein said passageway includes a restriction for braking the movement of said body towards said contact means.

10. A gravity actuated switching system as set forth in claim 8 wherein said body is a disc and said passageway has a non-round cross-section.

11. A gravity actuated switching system as set forth in claim 8 wherein said body is electrically conductive.

12. A gravity actuating switching system as set forth in claim 11 wherein said passageway includes electrically conductive walls.

13. A signal device comprising a buoyant housing signal means mounted at a lower end of said housing for emitting a signal;

a switch in said housing for actuating said signal means;

a passageway in said housing extending from said switch towards said lower end of said housing;

an element disposed within said passageway for actuating said switch, said element being movably disposed in said passageway near said lower end of said housing for movement through said passageway under gravity toward an upper end of said housing in response to inversion of said housing; and means within said passageway to retard movement of said element through said passageway, said means including at least one pendular member mounted in said housing to move between a rest position and a position permitting movement of said element thereby.

14. A signal device comprising a buoyant housing;

signal means mounted at a lower end of said housing for emitting a signal; and a time-delayed gravity-operated switching system disposed in said housing for actuating said signal means in response to inversion of said housing with a time delay of at least 0.075 seconds, said switching system including a switch having contact means disposed in a normally open position, a tortuous passageway extending from said contact means including a series of at least three sections to change the direction of motion of a movable element therein and an element movably disposed in said passageway and sized to move through said passageway under gravity to close said contact means upon inversion of said housing.

15. A signal device comprising a buoyant housing;

signal means mounted at a lower end of said housing for emitting a signal; and a time-delayed gravity-operated switching system disposed in said housing for actuating said signal means in response to inversion of said housing, said switching system including a switch having contact means disposed in a normally open position, a tortuous passageway in the form of a helix extending from said contact means and an element movably disposed in said passageway and sized to move through said passageway under gravity to close said contact means.

16. A signal device comprising a buoyant housing;

signal means mounted at a lower end of said housing for emitting a signal; and a time-delayed gravity-operated switching system disposed in said housing for actuating said signal means in response to inversion of the housing, said switching system includes a switch having contact means disposed in a normally open position, a tortuous spiral passageway extending from said contact means and an element movably disposed in said passageway and sized to move through said passageway under gravity to close said contact means.

* * * * *

UNITED STATES PATENT AND TRADEMARK OFFICE

CERTIFICATE OF CORRECTION

PATENT NO. : 4,669,990

DATED : June 2, 1987

INVENTOR(S) : Kevin McDermott

It is certified that error appears in the above-identified patent and that said Letters Patent is hereby corrected as shown below:

Column 5, line 10 "restrction" should be -restriction-

Signed and Sealed this

Seventeenth Day of November, 1987

*Attest:*

DONALD J. QUIGG

*Attesting Officer*

*Commissioner of Patents and Trademarks*